US011492574B2

(12) United States Patent
Sun et al.

(10) Patent No.: US 11,492,574 B2
(45) Date of Patent: Nov. 8, 2022

(54) UNIT DOSE DETERGENT PACK INCLUDING A LIQUID DETERGENT COMPOSITION COMPRISING AN ALKYL POLYGLYCOSIDE SURFACTANT

(71) Applicant: Henkel AG & Co. KGaA, Duesseldorf (DE)

(72) Inventors: Wei Sun, Trumbull, CT (US); Narcisse N. Toussa, Seymour, CT (US); Kimberly Lockwood, New Milford, CT (US); Casey Camire, Wallingford, CT (US)

(73) Assignee: Henkel AG & Co. KGaA, Duesseldorf (DE)

( * ) Notice: Subject to any disclaimer, the term of this patent is extended or adjusted under 35 U.S.C. 154(b) by 39 days.

(21) Appl. No.: 16/777,282

(22) Filed: Jan. 30, 2020

(65) Prior Publication Data

US 2021/0238511 A1 Aug. 5, 2021

(51) Int. Cl.

| | |
|---|---|
| ***C11D 1/04*** | (2006.01) |
| ***C11D 1/20*** | (2006.01) |
| ***C11D 1/72*** | (2006.01) |
| ***C11D 1/83*** | (2006.01) |
| ***C11D 3/22*** | (2006.01) |
| ***C11D 17/04*** | (2006.01) |
| ***C11D 1/76*** | (2006.01) |

(52) U.S. Cl.

CPC ..... *C11D 17/043* (2013.01); *C11D 1/04* (2013.01); *C11D 1/72* (2013.01); *C11D 1/76* (2013.01); *C11D 1/83* (2013.01)

(58) Field of Classification Search

CPC .. C11D 1/04; C11D 1/20; C11D 1/662; C11D 1/72; C11D 1/83; C11D 3/22; C11D 17/042

See application file for complete search history.

(56) References Cited

U.S. PATENT DOCUMENTS

| | | | | |
|---|---|---|---|---|
| 5,616,781 | A | 4/1997 | Sajic et al. | |
| 6,024,943 | A | 2/2000 | Ness et al. | |
| 6,056,949 | A | 5/2000 | Menzi et al. | |
| 6,194,375 | B1 | 2/2001 | Ness et al. | |
| 6,458,754 | B1 | 10/2002 | Velazquez et al. | |
| 7,709,436 | B2 | 5/2010 | Theiler et al. | |
| 8,426,353 | B2 | 4/2013 | Ouali et al. | |
| 8,716,213 | B2 | 5/2014 | Caggioni et al. | |
| 2004/0033922 | A1* | 2/2004 | Gorlin ..... | C11D 17/042 510/296 |
| 2010/0160201 | A1 | 6/2010 | Scheuing et al. | |
| 2011/0224127 | A1 | 9/2011 | Blyth et al. | |
| 2014/0148375 | A1* | 5/2014 | Urbin ..... | C11D 1/86 510/494 |
| 2017/0335237 | A1 | 11/2017 | Fossum et al. | |
| 2019/0185785 | A1 | 6/2019 | Seiler et al. | |

FOREIGN PATENT DOCUMENTS

| | | | |
|---|---|---|---|
| CN | 109536294 | A | 3/2019 |
| EP | 2441824 | A1 | 4/2012 |
| WO | 9532997 | A1 | 12/1995 |
| WO | 2010069957 | A1 | 6/2010 |

OTHER PUBLICATIONS

Extended EP Search Report EP 21153410.2 Completion Date: Jun. 8, 2021; dated Jun. 16, 2021 18 pages.

* cited by examiner

*Primary Examiner* — Brian P Mruk

(74) *Attorney, Agent, or Firm* — Bojuan Deng

(57) ABSTRACT

A unit dose detergent pack includes a pouch formed from a water-soluble film and a liquid detergent composition releasably disposed within the pouch. The liquid detergent composition includes at least two surfactants including from about 3 to about 20% by weight of alkyl polyglycoside and from about 15 to about 70% by weight of an additional surfactant, from about 13 to about 34% by weight of a fatty acid thereof, and less than about 30% by weight of water, with all weight percents based on a total weight of the liquid detergent composition.

8 Claims, No Drawings

UNIT DOSE DETERGENT PACK INCLUDING A LIQUID DETERGENT COMPOSITION COMPRISING AN ALKYL POLYGLYCOSIDE SURFACTANT

FIELD OF THE INVENTION

The present disclosure relates generally to unit dose detergent packs and, more particularly, to a unit dose detergent pack including a liquid detergent composition comprising an alkyl polyglycoside surfactant.

BACKGROUND OF THE INVENTION

Eco-friendly detergent compositions typically include ingredients that have no significant impact on the environment. Many eco-friendly detergent compositions include an alkyl polyglycoside (APG), a nonionic surfactant derived from plants. Although suitable for liquid detergent compositions having a high concentration of water (e.g., greater than 30% by weight), difficulties arise when incorporating the APG into a detergent composition requiring a low concentration of water (e.g., less than 30% by weight) such as for unit dose detergent packs. First, the APG is commercially available as a concentrated aqueous solution. This poses a limit on the amount of APG that can be incorporated into a detergent composition requiring a low water content because of the additional water from the APG solution. Second, the APG tends to interact with the water-soluble film of the unit dose pack, resulting in a higher swelling ratio and reduced elasticity of the water-soluble film. This leads to undesirable floppiness and potential leaking of the unit dose detergent pack. The present disclosure is aimed at solving the problems identified above.

SUMMARY OF THE INVENTION

The present disclosure provides a unit dose detergent pack comprising a pouch formed from a water-soluble film and a liquid detergent composition releasably disposed within the pouch. The liquid detergent composition includes at least two surfactants including from about 3 to about 20% by weight of alkyl polyglycoside based on a total weight of said liquid detergent composition and from about 15 to about 70% by weight of an additional surfactant based on a total weight of the liquid detergent composition. The liquid detergent composition further includes from about 13 to about 34% by weight of a fatty acid based on a total weight of the liquid detergent composition and less than about 30% by weight of water based on a total weight of the liquid detergent composition.

The present disclosure further provides a liquid detergent composition. In an embodiment, the liquid detergent composition comprises at least two surfactants including from about 3 to about 20% by weight of an alkyl polyglycoside based on a total weight of the liquid detergent composition and from about 15 to about 70% by weight of an additional surfactant based on a total weight of the liquid detergent composition. The liquid detergent composition further comprises from about 13 to about 34% by weight of a fatty acid based on a total weight of the liquid detergent composition and less than about 30% by weight of water based on a total weight of the liquid detergent composition.

In another embodiment, the liquid detergent composition comprises at least two surfactants including from about 5 to about 15% by weight of an alkyl polyglycoside based on a total weight of the liquid detergent composition and from about 15 to about 30% by weight of an alcohol ethoxylate based on a total weight of the liquid detergent composition. The liquid detergent composition further comprises from about 18 to about 24% by weight of a fatty acid thereof based on a total weight of said liquid detergent composition with said fatty acid having the formula $R^3COOH$ wherein $R^3$ is a primary or secondary alkyl group having from 4 to 30 carbon atoms and/or having the formula $R^3COOM$ wherein $R^3$ is a primary or secondary alkyl group having from 4 to 30 carbon atoms and M is a cation chosen from $Na^+$, a hydroxyethylammonium ion, and combinations thereof. The liquid detergent composition further comprises from about 10 to about 20% by weight of water based on a total weight of the liquid detergent composition.

DETAILED DESCRIPTION OF THE INVENTION

The following detailed description is merely exemplary in nature and is not intended to limit the unit dose detergent pack or the liquid detergent composition of the present disclosure. Furthermore, there is no intention to be bound by any theory presented in the preceding background or the following detailed description.

Embodiments of a unit dose detergent pack and a liquid detergent composition for the unit dose detergent pack are described in detail below. The unit dose detergent pack includes a pouch formed from a water-soluble film and a liquid detergent composition releasably disposed within the pouch. Details of the liquid detergent composition are described first and details of the pouch and the water-soluble film are described afterwards.

The liquid detergent composition includes an alkyl polyglycoside (APG), a nonionic surfactant derived or obtained from plants. The presence of the APG surfactant advantageously provides improved foaming of the detergent composition, is mild on the human skin, and is an eco-friendly ingredient favorable for the environment. The liquid detergent composition of the present disclosure further includes a fatty acid thereof present in an amount of from about 13 to about 34% by weight based on a total weight of the liquid detergent composition. The liquid detergent composition including the APG and the fatty acid, with the fatty acid content from about 13 to about 34% by weight, surprisingly and unexpectedly interacts favorably with the water-soluble film of the unit dose pack. As demonstrated in at least Example 2 of the Example section below, interaction between the liquid detergent composition of the present disclosure and the water-soluble film resulted in minimal swelling and no adverse effect on the spring constant of the water-soluble film. This means that the unit dose pack maintains its structural integrity upon interaction between the liquid detergent composition and the water-soluble film of the unit dose pack. As also demonstrated in at least Example 2 below, compositions having the APG and a low water content and a fatty acid outside of the 13 to 34 wt % range caused swelling and a reduced elasticity of the water-soluble film, leading to undesirable weeping, floppiness, and/or leaking of the unit dose pack.

In addition, the dilution rheology of a liquid detergent composition including an APG surfactant surprisingly and unexpectedly remains controlled when the liquid detergent composition also includes 13 to 34 wt % fatty acid content. In contrast, and as demonstrated in at least Example 2 below, the liquid detergent compositions including a high concentration of fatty acid and including no APG have dilution rheology problems. Failure to control the dilution rheology may lead to clogging in the piping system of high efficiency laundry machines when water is added to dissolve the unit dose pack in the dosing tray.

As used herein, the term "detergent" refers to a substance, preparation, agent, and/or the like having a mixture of surfactants having cleansing properties. One example is a laundry detergent, which is a detergent formulated for washing or cleaning laundry. Another example is a dishwashing detergent, which is a detergent formulated for washing or cleaning dishware, drinking glasses, eating or cooking utensils, etc. The detergent may be specifically formulated for use in washing and cleaning processes performed with a washing machine or for use in washing or cleaning processes performed by hand.

Surfactants

The liquid detergent composition includes a surfactant. In an embodiment, the liquid detergent composition includes at least two surfactants. The surfactants are used in the liquid detergent composition to facilitate foaming and stain removal, as well as to minimize redeposition of soils onto fabrics. The surfactants include an alkyl polyglycoside (APG) and an additional surfactant. The APG is a nonionic surfactant derived or obtained from plants, and may be referred to as a natural surfactant and/or eco-friendly ingredient of the liquid detergent composition. In an embodiment, the APG is a fatty ether derivative of a saccharide or a polysaccharide formed from a carbohydrate reacted under acidic conditions with a fatty alcohol through a condensation polymerization reaction. The APG may be formed from corn-based carbohydrates and fatty alcohols from natural oils in animals, coconuts, and palm kernels. Methods of forming the APG by the reaction of the carbohydrate and the fatty alcohol are known in the art. In an embodiment, the APG contains a hydrophilic group from the carbohydrate and is composed of one or more anhydroglucose units. Each of the anhydroglucose units may have two ether oxygen atoms and three hydroxyl groups along with a terminal hydroxyl group, which together impart water solubility to the alkyl polyglycoside. The alkyl carbon chain, which may be saturated or unsaturated, forms the hydrophobic tail of the alkyl polyglycoside. The alkyl polyglycoside molecules are formed having single or multiple anhydroglucose units, often referred to as monoglycosides and polyglycosides, respectively. The final alkyl polyglycoside product typically has a distribution of varying concentration of glucose units, i.e., degree of polymerization.

In an embodiment, the APG has saccharide or polysaccharide groups (such as mono-, di-, tri-, etc. saccharides) of hexose or pentose, and a fatty aliphatic group having 6 to 20 carbon atoms or, more typically, 8 to 16 carbon atoms. In another embodiment, the APG is represented by Formula (1):

$$G_x\text{-O—}R^1 \quad (1);$$

wherein G is a moiety obtained from reducing a saccharide having 5 or 6 carbon atoms (such as pentose or hexose). Non-limiting examples of saccharides from which G may be obtained include glucose, fructose, mannose, galactose, talose, gulose, allose, altrose, idose, arabinose, xylose, lyxose, and ribose. $R^1$ is fatty alkyl group having 6 to 20 carbon atoms, and x is the degree of polymerization of the polyglycoside which represents the number of monosaccharide repeating units in the polyglycoside. Typically, x is an integer on the basis of individual molecules; however, since there are statistical variations in the manufacturing processes for APGs, x may be a noninteger on an average basis when APG is used as an ingredient in the liquid detergent composition. In an embodiment, x has a value of less than 2.5. In another embodiment, x has a value of from 1 to 2. In yet another embodiment, x has a value of from 1.4 to 1.6.

In an embodiment, the APG is an alkyl polyglycoside derived from glucose and shown by Formula (2):

(2)

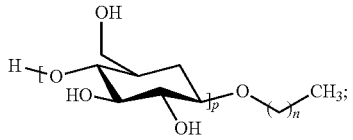

wherein n represents a number from 7 to 15. In another embodiment, n is from 7 to 9 or from 11 to 15. The letter p in Formula (2) above represents a number from 1 to 100. In another embodiment, p represents a number from 1 to 10.

The degree of oligomerization p in Formula (2) is less than 8. In another embodiment, the degree of oligomerization p in Formula (2) is less than 6. In another embodiment, the degree of oligomerization p in Formula (2) is less than 4. In yet embodiment, the degree of oligomerization p in Formula (2) is less than 2. In a particular embodiment, p is a number from 1.4 to 1.8. The fractional degrees of oligomerization may be achieved by mixtures containing varying amounts of surfactants of Formula (2), where p represents an integer, such as 1, 2, 3, or 4, for the single molecule.

The APG is commercially available from BASF Corp. (Florham Park, N.J.) under the tradename GLUCOPON®, including but not limited to GLUCOPON® 600UP, GLUCOPON® 215UP, and GLUCOPON® 225UK. Notably, these commercially available products are concentrated aqueous solution of APG. The water content in these products range from 30 to about 50% by weight based on the total weight of the solution. It should be appreciated that the water content of the commercially available forms of APG is taken into account when determining the total amount of water in the liquid detergent composition.

The APG is present in the composition in an amount of from about 3 to about 20% by weight based on a total weight of the liquid detergent composition. In another embodiment, the APG is present in the composition in an amount of from about 5 to about 20% by weight based on a total weight of the liquid detergent composition. In another embodiment, the APG is present in the composition in an amount of from about 5 to about 15% by weight based on a total weight of the liquid detergent composition. In yet another embodiment, the APG is present in the composition in an amount of from about 9 to about 15% by weight based on a total weight of the liquid detergent composition. In a particular embodiment, the APG is present in an amount of about 14.3% by weight based on a total weight of the liquid detergent composition.

The liquid detergent composition further includes an additional surfactant. In an embodiment, the liquid detergent composition includes at least additional surfactant. In another embodiment, the additional surfactant is a nonionic surfactant, such as an alcohol ethoxylate. The alcohol ethoxylate may be a primary or secondary alcohol ethoxylate, such as $C_8$-$C_{20}$ aliphatic alcohols ethoxylated with an average of from 1 to 20 moles of ethylene oxide per mole of alcohol. In another embodiment, the alcohol ethoxylate is a $C_{10}$-$C_{15}$ primary and secondary aliphatic alcohol ethoxylated with an average of from 1 to 10 moles, or from 3 to 8 moles of ethylene oxide per mole of alcohol.

Examples of alcohol ethoxylates include, but are not limited to, the condensation products of aliphatic $C_8$-$C_{20}$ primary or secondary, linear or branched chain alcohols with ethylene oxide. In some embodiments, the alcohol ethoxylates include 1 to 20, or 3 to 8 ethylene oxide groups, and may be end-capped by a hydroxylated alkyl group.

In one embodiment, the alcohol ethoxylate has Formula (3):

$$R^2—(—O—C_2H_4—)_m—OH \quad (3);$$

wherein $R^2$ is a hydrocarbyl group having 8 to 16 carbon atoms and M is a number from 1 to 20. In another embodiment, $R_2$ is a hydrocarbyl group having 8 to 14 carbon atoms, 8 to 12 carbon atoms, or 8 to 10 carbon atoms, and M is a number from 3 to 8.

The hydrocarbyl group may be linear or branched, and saturated or unsaturated. In some embodiments, $R_2$ is a linear or branched $C_8$-$C_{16}$ alkyl or a linear group or branched $C_8$-$C_{16}$ alkenyl group. In an embodiment, $R_2$ is a linear or branched $C_8$-$C_{16}$ alkyl, $C_8$-$C_{14}$ alkyl, or $C_8$-$C_{10}$ alkyl group. The alcohol may be derived from natural or synthetic feedstock. In another embodiment, the alcohol feedstock is coconut, having predominantly $C_{12}$-$C_{14}$ alcohol, and oxo $C_{12}$-$C_{15}$ alcohols.

Non-limiting examples of the alcohol ethoxylate include TOMADOL available from Evonik Corp. (Essen, Germany) and NEODOL® available from Shell Global (The Hague, The Netherlands).

It should be appreciated that, in certain embodiments, the plurality of surfactants could also include anionic surfactants, cationic surfactants, amphoteric (zwitterionic) surfactants, etc. For example, the plurality of surfactants could include anionic surfactants such as alkyl ether sulfates (AES), such as sodium alkyl ether sulfate, and sodium alkyl sulfates, such as sodium lauryl sulfates (SLS). Additionally, the plurality of surfactants could include other selected nonionic surfactants. In an embodiment, the liquid detergent composition is free from an alkylbenzene sulfonate, such as linear alkylbenzene sulfonate (LAS), and an alkylbenzene sulfonic acid, such as linear alkylbenzene sulfonic acid (HLAS).

The additional surfactant(s) (i.e., the surfactants other than the APG) is present in the composition in an amount of from about 15 to about 70% by weight based on a total weight of the liquid detergent composition. In another embodiment, the additional surfactant(s) is present in the composition in an amount of from about 15 to about 60% by weight based on a total weight of the liquid detergent composition. In another embodiment, the additional surfactant(s) is present in the composition in an amount of from about 15 to about 50% by weight based on a total weight of the liquid detergent composition. In yet another embodiment, the additional surfactant(s) is present in the composition in an amount of from about 15 to about 30% by weight based on a total weight of the liquid detergent composition. In one particular embodiment, the additional surfactant is an alcohol ethoxylate and is present in an amount of about 23.1% by weight based on a total weight of the liquid detergent composition.

Fatty Acid

The liquid detergent composition includes a fatty acid. Suitable fatty acids include those having the Formula (4):

$$R^3COOH \quad (4);$$

wherein $R^3$ is a primary or secondary alkyl group having from 4 to 30 carbons atoms, or from 8 to 18 carbon atoms. The fatty acids may also be used in a neutralized form having the Formula (5):

$$R^3COOM \quad (5);$$

wherein $R^3$ is a primary or secondary alkyl group having from 3 to 40 carbon atoms or from 8 to 18 carbon atoms, and M is a cation chosen from Na+, a hydroxyethylammonium ion (MEA+), triethanolammonium ion (TEA+), K+, NH4+, ½Zn2+, ½Mg3+, ½Ca2+, ½Mn2+, and combinations thereof. In another embodiment, M is a cation chosen from Na+, MEA+, and combinations thereof.

The alkyl group represented by $R^3$ in Formulas 4 and 5 above may have a mixture of chain lengths and may be saturated or unsaturated. In an embodiment, at least two thirds of the $R^3$ groups have a chain length of from 8 to 18 carbon atoms. In another embodiment, the alkyl group may be obtained from coconut oil, tallow, tall oil, rapeseed, oleic, fatty alkylsuccinic, palm kernel oil, and combinations thereof. In another embodiment, the fatty acid is a saturated carboxylic acid.

Typically, a majority of the fatty acid is incorporated into the liquid detergent composition in a neutralized salt form. However, it may desirable to leave an amount of free fatty acid in the composition as well. The free fatty acid can aid in maintaining the viscosity of the composition having a low water content (less than 30%).

In another embodiment, the fatty acid may be chosen from one having a pKa less than the pH of the liquid detergent composition. The pH of the liquid detergent composition is, for example, from about 6 to about 10.5.

To achieve the desired controlled swelling and spring constant of the water-soluble film upon interaction between the liquid detergent composition and the unit dose pack, the amount of the fatty acid present in the composition is typically from about 13 to about 34% by weight based on a total weight of the liquid detergent composition. As demonstrated by the Example 2 in the Example section below, a unit dose pack that interacted with a composition having the APG surfactant and a fatty acid content less than 13% by weight swelled and had a reduced spring constant leading to an undesirably floppy dose pack. Also, a unit dose pack that interacted with a composition having the APG surfactant and a fatty acid content greater than 34% shrunk. With a fatty acid content of 13 to 34% by weight, upon interaction with the detergent composition, the film had desirably controlled swelling ratio and elasticity. In another embodiment, the fatty acid is present in the composition in an amount of from about 13 to about 30% by weight based on a total weight of the liquid detergent composition. In another embodiment, the fatty acid is present in the composition in an amount of from about 16 to about 30% by weight based on a total weight of the liquid detergent composition. In one particular embodiment, the fatty acid is present in the composition in an amount of from about 18 to about 24% by weight based on a total weight of the liquid detergent composition.

Water

The liquid detergent composition may further include water. When present, the water content includes the water from the commercially-available form of the APG and water that is added separately. In an embodiment, the total amount of water present in the composition is less than 30% by weight based on a total weight of the liquid detergent composition. The liquid detergent composition having less than 30% by weight of water is said to have a low water content, and is suitable for use in unit dose detergent packs.

In another embodiment, water is present in an amount of from about 10 to about 30% by weight based on a total weight of the liquid detergent composition. In another embodiment, water is present in an amount of from about 10 to about 20% by weight based on a total weight of the liquid detergent composition. In one particular embodiment, the liquid detergent composition includes about 13.4% by weight of water.

Non-Aqueous Solvent

The liquid detergent composition may further include a non-aqueous solvent. The non-aqueous solvent is used to help solubilize the APG and additional surfactant(s) to maintain homogeneity of the composition at various storage conditions and to keep the viscosity of the composition in a range for easy processing and manufacturing. Additionally, the non-aqueous solvent serves as a water-binding agent to reduce water activity of the composition. This reduces water transfer of the composition to the surrounding water-soluble container of the unit dose detergent pack to avoid swelling and/or leakage through the water-soluble film material of the container. The unit dose detergent pack is described below.

In an embodiment, the non-aqueous solvent includes monovalent or polyvalent alcohols and glycol ethers. Non-limiting examples of the non-aqueous solvent include ethanol, propylene glycol, butylene glycol, pentylene glycol, hexylene glycol, heptylene glycol, octylene glycol, diethylene glycol, triethylene glycol, 2-methyl-1,3-propanediol, glycerol, 1,3-propanediol, triacetin, ethyl acetate, benzyl alcohol, polyethylene glycol having a molecular weight of from 200 to 3000 g/mol, and combinations thereof. In one particular embodiment, the liquid detergent composition includes glycerol and propylene glycol as non-aqueous solvents.

In an embodiment, the non-aqueous solvent is present in the composition in an amount of from about 10 to about 40% by weight based on a total weight of the liquid detergent composition. In another embodiment, the non-aqueous solvent is present in the composition in an amount of from about 20 to about 35% by weight based on a total weight of the liquid detergent composition. In yet another embodiment, the non-aqueous solvent is present in the composition in an amount of from about 20 to about 28% by weight based on a total weight of the liquid detergent composition.

Additives

The liquid detergent composition may further include at least one additive. In certain embodiments, the liquid detergent composition may include a suspension polymer, such as an alkoxylated polyethyleneimine. In an embodiment, the alkoxylated polyethyleneimine has a polyethyleneimine backbone having a weight average molecular weight from about 300 to about 10,000. The polyethyleneimine backbone may be modified by either (1) one or two alkoxylation modifications per nitrogen atom depending, at least in part, on whether the modification occurs at an internal nitrogen atom or at a terminal nitrogen atom, in the polyethyleneimine backbone, the alkoxylation modification including the replacement of a hydrogen atom by a polyalkoxylene chain having an average of about 1 to about 40 alkoxy moieties per modification with the terminal alkoxy moiety of the alkoxylation modification capped with hydrogen, a $C_1$-$C_4$ alkyl, or combinations thereof, (2) a substitution of one $C_1$-$C_4$ alkyl moiety and one or two alkoxylation modifications per nitrogen atom depending, at least in part, on whether the substitution occurs at an internal nitrogen atom or at an terminal nitrogen atom, in the polyethyleneimine backbone, the alkoxylation modification including the replacement of a hydrogen atom by a polyalkoxylene chain having an average of about 1 to about 40 alkoxy moieties per modification with the terminal alkoxy moiety capped with hydrogen, a $C_1$-$C_4$ alkyl, or combinations thereof, or (3) a combination of (1) and (2).

The alkoxylation modification of the polyethyleneimine backbone includes the replacement of a hydrogen atom by a polyalkoxylene chain having an average of about 1 to about 40 alkoxy moieties, typically from about 5 to about 20 alkoxy moieties. The alkoxy moieties are selected from ethoxy (EO), 1,2-propoxy (1,2-PO), 1,3-propoxy (1,3-PO), butoxy (BO), and combinations thereof. In some embodiments, the polyalkoxylene chain is selected from ethoxy moieties and ethoxy/propoxy block moieties. The polyalkoxylene chain may be ethoxy moieties in an average degree of from about 5 to about 15 or the polyalkoxylene chain may be ethoxy/propoxy block moieties having an average degree of ethoxylation from about 5 to about 15 and an average degree of propoxylation from about 1 to about 16.

One specific alkoxylated polyethyleneimine has the general structure of Formula (6):

(6)

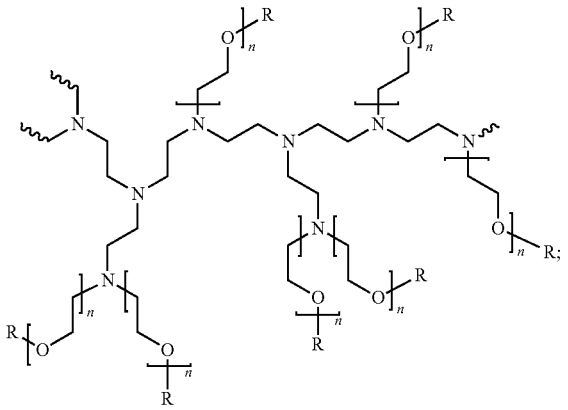

wherein the polyethyleneimine backbone has a weight average molecular weight of 600, n of Formula (6) has an average of 20, and each R is independently selected from hydrogen and a $C_1$-$C_4$ alkyl.

In an embodiment, the suspension polymer is a polyethyleneimine ethoxylate present in an amount of from about 0.1 to about 6% by weight based on a total weight of the liquid detergent composition.

The composition may further include, as an additive, a neutralizing agent. The neutralizing agent is chosen from an alkanolamine, a hydroxide, and combinations thereof. Non-limiting examples of the alkanolamine include monoethanolamine, diethanolamine, triethanolamine, isopropylamine, and/or the like. Non-limiting examples of the hydroxide include sodium hydroxide, potassium hydroxide, ammonium hydroxide, calcium hydroxide, and/or the like. In an embodiment, the neutralizing agent is present in an amount of from about 2 to about 8% by weight based on a total weight of the liquid detergent agent.

The composition may further include, as an additive, a bittering agent. The bittering agent imparts a bitter taste to the liquid detergent composition thereby hindering accidental ingestion of the composition by children, animals, etc. Non-limiting examples of bittering agents include denatonium benzoate (such as BITREX® available from Bitrex (Edinburgh, Scotland)), aloin, and/or the like.

The composition may further include, as an additive, one or more enzymes. The enzymes may be chosen amylolytic, proteolytic, cellulolytic, and/or lipolytic-type enzymes. Other suitable enzymes include, but are not limited to, proteases, amylases, lipases, and cellulases such as ALCALASE® (bacterial protease), EVERLASE® (protein-engineered variant of SAVINASE®), ESPERASE® (bacterial protease), LIPOLASE® (fungal lipase), LIPOLASE ULTRA® (Protein-engineered variant of LIPOLASE®), LIPOPRIME® (protein-engineered variant of LIPOLASE®), TERMAMYL® (bacterial amylase), BAN (Bacterial Amylase Novo), CELLUZYME® (fungal enzyme), and CAREZYME® (monocomponent cellulase), all available from Novo Nordisk Industries A/S (Bagsvaerd, Denmark). Blends of two or more enzymes may also be used, such as a protease/lipase blend, a protease/amylase blend, a protease/amylase/lipase blend, etc.

As another additive, the composition may include an optical brightener. Suitable optical brighteners include stilbenes such as TINOPAL® AMS available from BASF Corp., distyrylbiphenyl derivatives such as TINOPAL® CBS-X also available from BASF Corp., stilbene/naphthotriazole blends (e.g., TINOPAL® RA-16), oxazole derivatives, and/or coumarin brighteners.

An antifoam agent may also be used to reduce or hinder the formation of foam. Suitable antifoam agents include, but are not limited to, a polyalkoxylated alkanolamide, amide, amine oxide, betaine, sultaine, $C_8$-$C_{18}$ fatty alcohols, and those disclosed in U.S. Pat. No. 5,616,781, the which is incorporated hereby by reference in its entirely in non-limiting embodiments. An auxiliary foam stabilizing surfactant, such as a fatty acid amide surfactant, may also be included in the composition, such as $C_8$-$C_{20}$ alkanol amides, monoethanolamides, diethanolamides, or isopropanolamides. Other suitable antifoam agents include those derived from phenylpropylmethyl substitute polysiloxanes.

The composition may further include a dye transfer inhibitor to help prevent colorants (e.g., a dye) from coming off a fabric and being deposited onto another fabric during a washing cycle. The dye transfer inhibitors are polymers adapted to entrap dyes in the washing liquor. Non-limiting examples of dye transfer inhibitors include homopolymers and copolymers of vinylpyrrolidone and vinylimidazole.

As another additive, the composition may include a soil release agent. Suitable soil release agents are polymers such as, but not limited to, a nonionic polyester of polypropylene terephthalate such as TEXCARE® SRN available from Clariant, a polyethylene glycol polyester such as REPEL-O-TEX SRP available from Solvay, end-capped and non-end-capped sulfonated and unsulfonated PET/POET polymers of the type as disclosed in International Patent Publication Nos. WO2010/069957 and WO1995/032997, which are incorporated herein by reference in their entirety in various nonlimiting embodiments, polyethylene glycol/polyvinyl alcohol graft copolymers such as SOKALAN® HP22 available from BASF Corp., and/or anionic hydrophobic polysaccharides.

Colorants and fragrances may also be used, as additives, in the composition. Colorants suitable for use in the liquid detergent composition include dyes of a variety of different colors, such as blue, yellow, green, orange, green, purple, etc. Suitable dyes include, but are not limited to, chromophore types such as azo, anthraquinone, triarylmethane, methine quinophthalone, azine, oxazine, and thiazine which may be of any desired color, hue or shade. Suitable dyes may be obtained from Clariant, Ciba Speciality Chemicals, Dystar, Avecia, Bayer, or any other suitable manufacturer.

Fragrances may include any fragrant substance or mixture of substances including natural fragrances (such as those extracted from flowers, herbs, leaves, roots, barks, woods, blossoms, plants, etc.), artificial fragrances (such as natural oils or oil constituents), encapsulated, and synthetically produced fragrances. Non-limiting examples of fragrances that may be used in the composition are set forth in U.S. Pat. Nos. 6,024,943; 6,056,949; 6,194,375; 6,458,754; 8,716,213; and 8,426,353 and in United States Patent Publication Nos. 2011/0224127 and 2017/0335237, each of which are incorporated herein by reference in their entirety in various non-limiting embodiments.

The composition may further include, as another additive, an antimicrobial agent. Suitable antimicrobial agents include an antimicrobial, a germicide, or a fungicide. In an embodiment, the antimicrobial agent may be triclosan (5-chloro-2-(2,4-dichloro-phenoxy) phenol)), and/or the like.

Additional additives that may be incorporated into the liquid detergent composition include chelators, water softeners, buffers, processing aids, preservatives, and/or the like.

Unit Dose Detergent Pack

The unit dose detergent pack includes the pouch formed or made from the water-soluble film and, as mentioned above, the liquid detergent composition is releasably disposed within the pouch. Details of various embodiments of the liquid detergent composition are described above. The pouch defines at least one compartment and the liquid detergent composition is releasably disposed or encapsulated within the at least one compartment. The pouch may have a single compartment and the liquid detergent composition is releasably disposed within the single compartment. Alternatively, the pouch may have two or more compartments and the liquid detergent composition is releasably disposed within at least one of the two or more compartments. The other compartment(s) may include colorants or other components.

The pouch may be formed from a single continuous water-soluble film. In another embodiment, the pouch is formed from a plurality of water-soluble films joined and sealed to one another, such as along their edges such that the inner surfaces of the water-soluble films collectively define the compartment. In an embodiment, the film is water-soluble such that the film completely dissolves when exposed to water, such as in a washing machine for washing laundry. When the film dissolves, the pouch ruptures and the contents of the pouch (e.g., the liquid detergent composition) are released. As used herein, the term "water-soluble" means that least 2 grams of the solute (e.g., the film) dissolves in 5 liters of solvent (e.g., water) for a solubility of at least 0.4 grams per liter (g/l) at a temperature of 25° C. unless otherwise specified.

The film is desirably strong, flexible, shock resistant, and non-tacky during storage at both high and low temperatures and high and low humidities. Non-limiting examples of suitable materials for the water-soluble film include polyvinyl alcohol, polyvinyl acetate, film-forming cellulosic polymers, polyacrylic acid, polyacrylamide, polyanhydride, polysaccharide, and combinations thereof.

Film Parameters

It is desirable that the unit dose detergent pack maintains its structural integrity upon interaction between the liquid detergent composition and the water-soluble film. The structural integrity of the unit dose detergent pack can be surprisingly and unexpectedly maintained upon interaction between the water-soluble film and the liquid detergent composition including APG and a fatty acid having a concentration of from about 13 to about 34% by weight. The Examples below show that interaction between the liquid detergent composition and the water-soluble film results in minimal swelling and no adverse effect on the spring constant of the water-soluble film. In an embodiment, upon interaction with the liquid detergent composition, the water-soluble film has a swelling ratio of less than or equal to 30% and a spring constant of greater than 1.0 N/mm. In another embodiment, upon interaction with the liquid detergent composition, the water-soluble film has a swelling ratio of less than or equal to 20% and a spring constant of greater than 1.5 N/mm. Accordingly, since the structural integrity is maintained, the unit dose pack is less likely to weep, flop, and/or leak.

The following examples are meant to illustrate the instant disclosure and are not to be viewed in any way as limiting the scope of the present claims.

EXAMPLES

Example 1

Two samples of a liquid detergent composition were prepared. One of the samples (Sample 1) was prepared as a liquid detergent composition including APG as a co-surfactant. The other one of the samples (Sample 2) was prepared as a liquid detergent composition including linear alkylbenzene sulfonic acid (HLAS) as a co-surfactant. The compositions of Samples 1 and 2 are set forth in Table 1 below.

TABLE 1

Compositions of Samples 1 and 2

| Ingredient | Sample 2 (wt. %) | Sample 1 (wt. %) |
|---|---|---|
| Alcohol ethoxylate (AEO (C24-7)) | 23.0 | 23.0 |
| Alkyl ether sulfate (AES (C25-3)) | 5.7 | 5.7 |
| Linear alkylbenzene sulfonic acid (HLAS) | 9.0 | — |
| Alkyl polyglycoside (APG) | — | 9.0 |
| Fatty Acid | 16.0 | 16.0 |
| Monoethanolamine | 5.4 | 3.3 |
| SOKALAN ® HP20* (ethoxylated polyethylenimine) | 1.6 | 1.6 |
| Glycerol | 15.7 | 17.7 |
| Propylene glycol | 8.2 | 8.2 |
| Water | 13.4 | 13.4 |

Samples 1 and 2 were used in various film strip testing methods to quantify parameters surrounding the interaction between the liquid detergent compositions and a water-soluble film of a unit dose pack (i.e., the liquid-film interaction). In each of the tests, strips of polyvinyl acetate and polyvinyl alcohol (PVAc-PVOH) were used as the water-soluble film.

Swelling Ratio

A first test was conducted to determine a swelling ratio, which is expressed as a percentage and is used to describe the degree to which the liquid and the film interact. In this test, three film strips for each sample (six strips total) were prepared by cutting three identical 3 cm by 7 cm (3×7) strips from a fresh sheet of film material. Each of the strips were labeled, weighed using a tared weigh boat, and arranged in a petri dish. In particular, the strips were arranged by placing the two of the strips in parallel with one of the strips slightly overlapping the other one of the strips, and then placing the third strip across (perpendicularly) over the first two strips.

The petri dish was filled with enough of the liquid sample to submerge the three film strips (about 18 to 25 g of liquid was used in this test). The petri dish was wrapped and sealed with parafilm and placed in a calibrated chamber at a temperature of about 40.6° C. (about 105° F.) for two weeks. After the two-week period, the petri dish was removed from the chamber and the film strips were removed from the petri dish utilizing tweezers. After allowing the strips to drip for a few seconds, excess liquid was removed by placing the strips in numerical order on one half of a sheet of Wypall paper towel. The other side of the paper towel was folded over to cover the strips and a smooth glass cylinder or rod was rolled over the films (about 15 passes) for additional drying. The paper towel was unfolded, the strips were transferred in the same arrangement to another sheet of Wypall paper towel, and the drying process was repeated. The dried strips were then transferred to individually labeled weigh boats for a weight measurement of each strip including the absorbed liquid using an analytical scale.

The weight of the liquid absorbed by the film is the difference between the original weight of the film and the final weight of the film. The swelling ratio was then determined as the ratio of the weight of the absorbed liquid to the weight of the original film converted to a percentage (%). The results are set forth in Table 2 below.

TABLE 2

Swelling Ratio

| | Sample 1 | Sample 2 |
|---|---|---|
| Swelling Ratio | 11.79% | 18.81% |

Spring Constant

A second test was conducted to determine a spring constant (N/mm) of the film strip, a parameter that denotes how the liquid detergent composition can impair the structure of the film strip. This is mostly due to interactions between the surfactant, solvent, and the water of the composition and the polymer-plasticizer of the film strip. The process utilized a tensiometer (available from Tinius Olsen) equipped with a 250N load cell and loaded into a QMat Test Zone. The tensiometer settings are set forth in Table 3 below.

TABLE 3

Tensiometer Settings

| Parameter | Value |
|---|---|
| Load Range (N) | 250 |
| Extension Range (mm) | 2000 |
| Unit Extension (mm) | 1000 |
| Extension (mm) | 2 |
| Preload (N) | 0.1 |

The dried film strips from the previous swelling test were loaded into the tensiometer with the strips placed perpendicular to the tensiometer grips. The film strips were extended or stretched about 2 mm, and a force (N) was measured by the tensiometer and then recorded. A force/displacement curve for each of the film strips was generated, and the spring constant (N/mm) of each strip tested was determined from the respective curve. The average spring constant (N/mm) was determined from the spring constants of the strips, and the results were recorded in Table 4 below.

TABLE 4

| Spring Constant | | |
|---|---|---|
| | Sample 1 | Sample 2 |
| Spring Constant (N/mm) | 1.99 | 1.64 |

Results

The results of the film strip tests show that simply replacing HLAS co-surfactant with APG co-surfactant, with nothing more, resulted in a higher swelling ratio and a lower spring constant of the film strips after interaction with the liquid detergent composition at 40° C. for a two-week period. These results are undesirable, as swelling and a reduced spring constant of the film strips leads to weeping, floppiness, and even leaking of the unit dose pack. Therefore, a liquid detergent composition including APG co-surfactant as a simple replacement of the HLAS co-surfactant, with nothing more, produces undesirable results.

Example 2

Nine samples of a liquid detergent composition were prepared. Two of the samples were prepared as control samples (S1 and S2), which are liquid detergent compositions for a unit dose pack having acceptable haptic profiles inside a water-soluble film. Notably, the first control composition (S1) included an alcohol ethoxylate (AEO), an alkyl ether sulfate (AES), and a linear alkylbenzene sulfonic acid (HLAS) as surfactants and a fatty acid. The second control composition (S2) included just the AEO and HLAS as surfactants and the fatty acid.

Three of the samples were prepared as comparative samples (S3, S4, S5), which are liquid detergent compositions for a unit dose pack including APG and AEO as surfactants and the fatty acid. Notably, S3 and S4 included 3.3% by weight and 8.5% by weight of the fatty acid, and S5 included 34.2% by weight of the fatty acid.

Four of the samples were prepared as compositions representative of the present disclosure (S6, S7, S8, S9), which are liquid detergent compositions for a unit dose pack including APG and AEO surfactants and the fatty acid. Notably, the fatty acid in samples S6-S9 is present in an amount ranging from 13.6% by weight (S6) to 23.9% by weight (S9).

The compositions of the samples S1-S9 are set forth in Table 5 below.

TABLE 5

| Compositions of samples S1-S9 | | | | | | | | | |
|---|---|---|---|---|---|---|---|---|---|
| Ingredient | S1 (wt %) | S2 (wt %) | S3 (wt %) | S4 (wt %) | S5 (wt %) | S6 (wt %) | S7 (wt %) | S8 (wt %) | S9 (wt %) |
| AEO (C24-7) | 23.1 | 23.1 | 23.1 | 23.1 | 23.1 | 23.1 | 23.1 | 23.1 | 23.1 |
| AES (C25-7) | 5.7 | — | — | — | — | — | — | — | — |
| HLAS | 14.7 | 14.4 | — | — | — | — | — | — | — |
| APG* | — | — | 14.3 | 14.3 | 14.3 | 14.3 | 14.3 | 14.3 | 14.3 |
| Fatty Acid | 10.0 | 18.0 | 3.3 | 8.5 | 34.2 | 13.6 | 18.8 | 18.8 | 23.9 |
| Glycerol | 13.0 | 12.6 | 22.5 | 10.2 | 8.0 | 16.3 | 22.5 | 4.0 | 10.2 |
| Propylene glycol | 8.2 | 11.0 | 22.5 | 28.7 | 8.0 | 16.3 | 4.0 | 22.5 | 10.2 |
| Water | 12.9 | 12.9 | 13.4 | 13.4 | 13.4 | 13.4 | 13.4 | 13.4 | 13.4 |

*APG was obtained from GLUCOPON ® 215UP available from BASF Corp. Notably, the amount of APG (in wt %) is the active wt % of APG.
** The fatty acid used was derived from palm kernel oil having from 8 to 18 carbon atoms.

Each of the samples S1-S9 were used in various film strip testing methods to quantify parameters surrounding the interaction between the liquid detergent composition and the water-soluble film of a unit dose pack; namely the swelling ratio, the spring constant, and a dilution rheology. In each of the tests, strips PVAc-PVOH were used as the water-soluble film for the unit dose detergent pack.

The swelling ratio and the spring constant of the water-soluble film were determined utilizing the same procedures described in detail above in Example 1. The dilution rheology is a parameter used to predict the dissolution behavior of the unit dose detergent pack. In particular, the dilution rheology is used to measure the viscosity of the liquid detergent composition upon dilution at 2:1 and 1:1 ratio of liquid product to water weight content. In this test, film strips were added to a petri dish, submerged in the liquid detergent composition, and the dish was then placed in a high temperature stability chamber. The strips were removed from the chamber, allowed to drip, placed in a beaker including a stir bar, and then filled with tap water.

The viscosity of the diluted liquid detergent composition at 2:1 and 1:1 dilution ratio was recorded at a shear rate of 1/s at 25° C. using an AR2000EX rheometer. Desirably, the viscosity of the diluted liquid detergent composition is lower than 1000 cps at a shear rate of 1/s at 25° C. In instances where the viscosity is higher than 1000 cps, the rheology test fails. In instances where the viscosity is equal to or lower than 1000 cps, the rheology test passes.

The results of all three tests are set forth in Table 6 below.

TABLE 6

| Results | | | | | |
|---|---|---|---|---|---|
| Sample | Swelling Ratio | Spring Constant (N/mm) | Vs. Control (S1 and S2) | 2:1 Dilution Rheology | 1:1 Dilution Rheology |
| S1 | 11.2 | 1.96 | | Pass (<1000 cps) | Pass (<1000 cps) |
| S2 | 4.3 | 1.95 | | Failed (>>1000 cps) | Pass (<1000 cps) |
| S3 | 59.1 | 0.58 | Floppier*** | Pass (<1000 cps) | Pass (<1000 cps) |
| S4 | 32.1 | 0.98 | Floppier*** | Pass (<1000 cps) | Pass (<1000 cps) |
| S5 | −6.9 | 4.31 | Shrunk | Failed (>>1000 cps) | Pass (<1000 cps) |
| S6 | 28.2 | 1.16 | Slightly Floppier** | Pass (<1000 cps) | Pass (<1000 cps) |
| S7 | 24.8 | 1.39 | Slightly Floppier** | Pass (<1000 cps) | Pass (<1000 cps) |

TABLE 6-continued

| Results | | | | | |
|---|---|---|---|---|---|
| Sam-ple | Swelling Ratio | Spring Constant (N/mm) | Vs. Control (S1 and S2) | 2:1 Dilution Rheology | 1:1 Dilution Rheology |
| S8 | 8.6 | 1.72 | Similar* | Pass (<1000 cps) | Pass (<1000 cps) |
| S9 | 7.6 | 1.91 | Similar* | Pass (<1000 cps) | Pass (<1000 cps) |

*"Similar" refers to the structure of the water-soluble film being similar to that of the control samples S1, S2, where the swelling ratio is from 0-20% and the spring constant is greater than 1.5.
**"Slightly Floppier" refers to the structure of the water-soluble film being slightly floppier compared to the control samples S1, S2, where the swelling ratio is 20-30% and the spring constant is 1.0-1.5.
***"Floppier" refers to the structure of the water-soluble film being floppier compared to the control samples S1, S2, where the swelling ratio is greater than 30% and the spring constant is less than 1.0.

The results shown in Table 6 above show that with more than 13% by weight of fatty acid present in the liquid detergent composition (Samples S6-S9), the swelling ratio of the water-soluble film falls within the acceptable range of less than 30%. In contrast, the swelling ratio of the comparison samples S3 and S4, which included less than 13% by weight of fatty acid, was higher than and therefore fell outside of the acceptable range of less than 30%. The results also show that with too much fatty acid in the liquid detergent composition (such as Sample S5 which included 34.2 wt % fatty acid), the film material shrunk which is also undesirable, Additionally, the spring constant of the water-soluble film, when absorbed with the liquid detergent composition of the present disclosure (S6-S9) fell within the acceptable range of at least 1.0 N/mm. The results above show that the detergent composition including APG and a fatty acid present in an amount of from 13 to 34% by weight produced desirable results, with Samples S8 and S9 producing results very similar to the control samples 51 and S2.

The results set forth in Table 6 above also show that all compositions of the present disclosure (S6-S9) passed the dilution rheology test (<1000 cps at 2:1 and 1:1 dilution). Surprisingly, the samples S7-S9 having APG and a fatty acid present in an amount greater than 18% by weight passed the rheology test, while the control sample S2 having the same amount of fatty acid but not APG surfactant gelled immediately upon 2:1 dilution. Additionally, the detergent composition of comparative sample S5 having APG and a fatty acid content of higher than 34% results in undesirable film shrinkage and failed the 2:1 dilution rheology test.

As used herein, the article "a," "an," and "the" can be used herein to refer to one or more than one (i.e., to at least one) of the grammatical object of the article unless the language and/or context clearly indicates otherwise.

As used herein, the term "about" is understood by persons of ordinary skill in the art and varies to some extent depending upon the context in which the term is used. If there are uses of the term which are not clear to persons of ordinary skill in the art, given the context in which the term is used, "about" means up to plus or minus 10% of the particular term.

It is to be understood that one or more values described above may vary by +/−5%, +/−10%, +/−15%, +/−20%, etc. so long as the variance remains within the scope of the present disclosure. It is also to be understood that the appended claims are not limited to express particular compounds, compositions, or methods described in the detailed description, which may vary between particular embodiments which fall within the scope of the appended claims.

It is also to be understood that any ranges or subranges relied upon in describing the various embodiments of the present disclosure independently and collectively fall within the scope of the appended claims, and are understood to describe and contemplate all ranges including whole and/or fractional values therein, even if such values are not expressly written herein. One of skill in the art readily recognizes that the enumerated ranges and subranges sufficiently describe and enable various embodiments of the present disclosure, and such ranges and subranges may be further delineated into relevant halves, thirds, quarters, fifths, and so on. Additionally, an individual number within a disclosed range may be relied upon and provides adequate support for specific embodiments within the scope of the appended claims. For example, a range "of from about 100 to about 200" includes various individual integers such as 101, 102, 103, etc., as well as individual numbers including a decimal point (or fraction) such as 100.1, 100.2, etc., which may be relied upon and provide adequate support for specific embodiments within the scope of the appended claims.

The present disclosure has been described in an illustrative manner, and it is to be understood that the terminology which has been used is intended to be in the nature of words of description rather than of limitation. It is now apparent to those skilled in the art that many modifications and variations of the present disclosure are possible in light of the above teachings. It is, therefore, to be understood that the present disclosure may be practiced otherwise than as specifically described.

What is claimed is:

1. A liquid detergent composition comprising:

from about 9 to about 15% by weight of an alkyl polyglycoside based on a total weight of said liquid detergent composition, and from about 15 to about 30% by weight of a synthetic alcohol ethoxylate based on a total weight of said liquid detergent composition;

from about 18 to about 24% by weight of a fatty acid based on a total weight of said liquid detergent composition with said fatty acid having the formula R3COOH wherein R3 is a primary or secondary alkyl group having from 4 to 30 carbon atoms and/or having the formula R3COOM wherein R3 is a primary or secondary alkyl group having from 4 to 30 carbon atoms and M is a cation chosen from Na+, a hydroxyethylammonium ion, and combinations thereof; and from about 10 to about 20% by weight of water based on a total weight of said liquid detergent composition, wherein the liquid detergent composition is free from anionic surfactant, wherein viscosity of the detergent composition when diluted 2:1 with water is lower than 1000 cps at a shear rate of 1/s at 25° C.

2. A unit dose detergent pack comprising:

a pouch formed from a water-soluble film; and the liquid detergent composition as set forth in claim 1 releasably disposed within said pouch.

3. The unit dose detergent pack as set forth in claim 1 wherein said fatty acid is obtained from coconut oil, tallow, tall oil, rapeseed, oleic, fatty alkylsuccinic, palm kernel oil, and combinations thereof.

4. The unit dose detergent pack as set forth in claim 1 wherein said liquid detergent composition further includes at least one non-aqueous solvent.

5. The unit dose detergent pack as set forth in claim 4 wherein said non-aqueous solvent is present in an amount of from about 15 to about 30% by weight based on a total weight of said liquid detergent composition.

6. The unit dose detergent pack as set forth in claim 1 wherein said water-soluble film is chosen from polyvinyl alcohol, polyvinyl acetate, film-forming cellulosic polymers, polyacrylic acid, polyacrylamide, polyanhydride, polysaccharide, and combinations thereof.

7. The liquid detergent composition as set forth in claim 6 wherein said fatty acid is obtained from coconut oil, tallow, tall oil, rapeseed, oleic, fatty alkylsuccinic, palm kernel oil, and combinations thereof.

8. The liquid detergent composition as set forth in claim 6, further comprising at least one non-aqueous solvent present in an amount of from about 15 to about 30% by weight based on a total weight of said liquid detergent composition.

* * * * *